US005184986A

United States Patent [19]

Wilkinson et al.

[11] Patent Number: 5,184,986

[45] Date of Patent: Feb. 9, 1993

[54] WRIST EXERCISE DEVICE

[75] Inventors: William T. Wilkinson, Crownsville, Md.; John J. Nelson, Bristol, Pa.

[73] Assignee: What-Not, Inc., Cleveland, Ohio

[21] Appl. No.: 894,537

[22] Filed: Jun. 5, 1992

[51] Int. Cl.[5] ..... A63B 23/14

[52] U.S. Cl. ..... 482/46; 482/118

[58] Field of Search ..... 482/45, 46, 118, 119, 482/114, 115, 121, 126, 44

[56] References Cited

U.S. PATENT DOCUMENTS

| | | | |
|---|---|---|---|
| 2,668,055 | 2/1954 | Sharp et al. . | |
| 3,184,234 | 5/1965 | Struble . | |
| 3,666,267 | 5/1972 | McKinney . | |
| 3,708,164 | 1/1973 | Griffin . | |
| 3,717,338 | 2/1973 | Hughes | 482/46 |
| 3,856,297 | 12/1974 | Schnell . | |
| 4,379,552 | 4/1983 | Webb . | |
| 4,591,151 | 5/1986 | Hensley . | |
| 4,643,417 | 2/1987 | Nieman | 482/46 |
| 4,695,049 | 9/1987 | Ciemiega . | |
| 4,702,474 | 10/1987 | Guibert . | |
| 4,838,542 | 6/1989 | Wilkinson | 482/45 |
| 5,046,727 | 9/1991 | Wilkinson et al. | 482/118 |

*Primary Examiner*—Stephen R. Crow
*Attorney, Agent, or Firm*—Connolly & Hutz

[57] ABSTRACT

A wrist exercise device includes a handle having an axial opening through which a bolt extends. A spring is around one end of the bolt disposed against an adjustment ring. A pressure plate is mounted at the opposite end of the handle between the handle and the head of the bolt. At least one clutch disc is disposed against the pressure plate. A knob is mounted around the pressure plate and cluch disc, mounted for relative rotational movement with respect to the handle. The wrist is exercised holding the handle and the knob and twisting one of the handle or knob relative to the other.

17 Claims, 2 Drawing Sheets

WRIST EXERCISE DEVICE

BACKGROUND OF INVENTION

Various types of wrist exercise devices are known art. One particularly effective device is disclosed in U.S. Pat. No. 5,046,727. Other devices are disclosed in U.S. Pat. Nos. 4,838,542 and 3,856,267. These devices basically operate by holding one portion of the device in one hand and grasping a knob with the other hand. The exercise is achieved by twisting the knob or handle in the opposition to resistance against the twisting motion.

SUMMARY OF THE INVENTION

An object of this invention is to provide a Wrist exercise device generally of the above type wherein the resistance of the device can be easily set and readily readjusted to compensate for any wear.

A further object of this invention is to provide such a device which would effectively operate in providing a wrist exercise.

In accordance with this invention the wrist exercise device includes a handle having an axial opening. A bolt extends completely through the opening with a spring mounted around one end of the bolt against an adjustment ring mounted around the bolt. The resistance offered by the spring can be readily adjusted by a twisting of the adjustment ring to axially compress or relax the spring. A pressure plate is disposed at the opposite end of the handle between the handle and the head of the bolt. At least one clutch disc is mounted against the handle and pressure plate with a knob disposed around the handle and the pressure plate and the disc for relative rotational movement with respect to the handle. The device would be operated by the user holding the handle in one hand and holding the knob with the other hand and then twisting the handle or knob.

In a preferred practice of the invention an adjustment ring cap is mounted to the bolt and is seated in the adjustment ring. The adjustment ring includes indicia on its exposed face to provide some indication of the amount of resistance which would be encountered in the use of the device. The cap includes an arrow pointing to the indicia. The spring may preferably be in the form of a bellville washer. Preferably two clutch discs are provided with each disc being on a separate side of an inward extension of a knob.

THE DRAWINGS

DETAILED DESCRIPTION

The present invention relates to a wrist exercise device which operates along the general principles of U.S.

Figure 5:
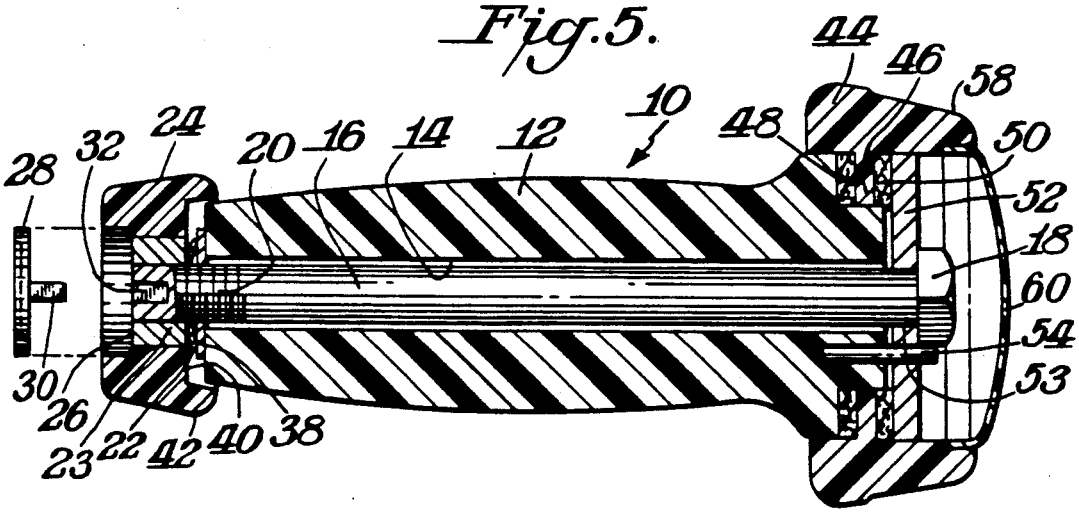
FIG. 5 is a cross-sectional view taken through FIG. 1 along the line 5—5.
Figure 6:
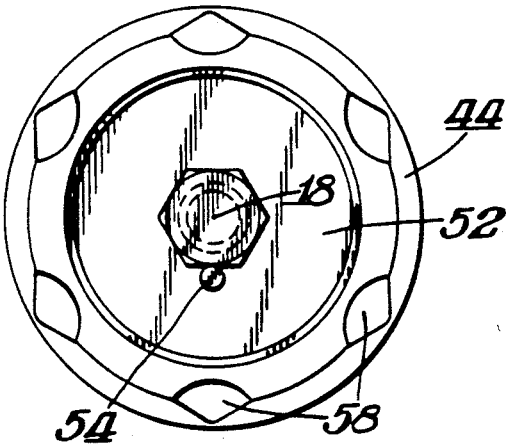
FIG. 6 is a view similar to FIG. 3 with the knob cap removed.

Pat. Nos. 5,046,727; 4,838,542 and 3,856,267, the details of which are incorporated herein by reference thereto. In general, wrist exercise device 10 comprises a handle 12 which has a textured outer surface to facilitate gripping by the user. As best shown in FIG. 5 handle 12 includes an axial opening 14 extending completely therethrough. A bolt 16 is mounted through the axial opening. Bolt 16 is threaded at one end 20 and has an enlarged head 18 at its second end.

As best shown in FIG. 5 spring means which is preferably in the form of a bellville washer 22 is mounted around threaded end 20 of bolt 16. Washer 22 functions as a compression spring which applies tension to the bolt as later described. An adjustment ring 24 is fixedly secured to internally threaded metal insert 23. The adjustment ring 24 and insert 23 are mounted in threaded engagement with end 20 spaced from handle 12. Spring or washer 22 is disposed between insert 23 and flat washer 38 against handle 12. When adjustment ring 24 is rotated clockwise it compresses washer 22 for increasing the resistance as later described. Conversely counterclockwise rotation decreases the resistance by permitting washer 22 to relax. Adjustment ring 24 includes a recess or seat 26 into which is mounted an adjustment cap 28 having a threaded extension or screw 30 which fits into an internally threaded opening 32 in threaded end 20 of bolt 16.

Figure 1:
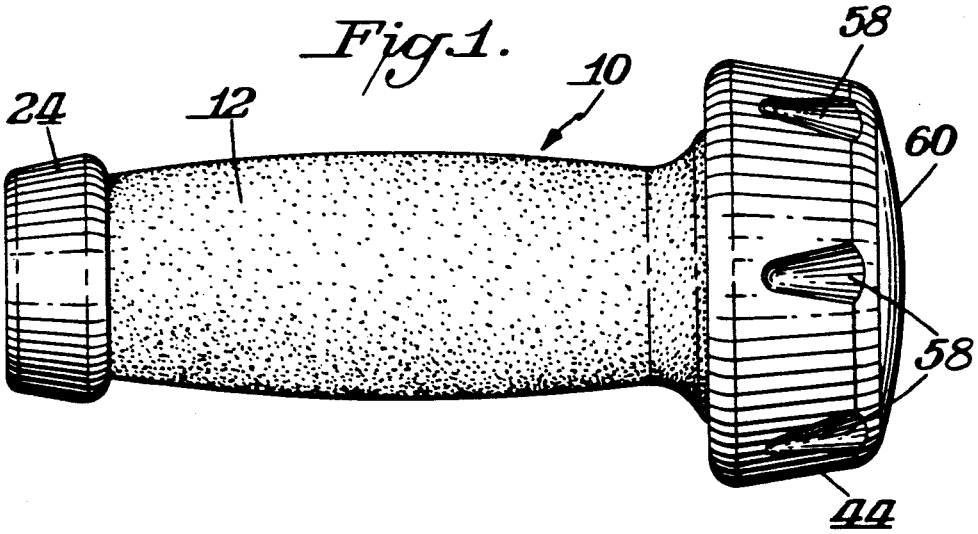
FIG. 1 is a top plan view of a wrist exercise device in accordance with this invention.
Figure 2:
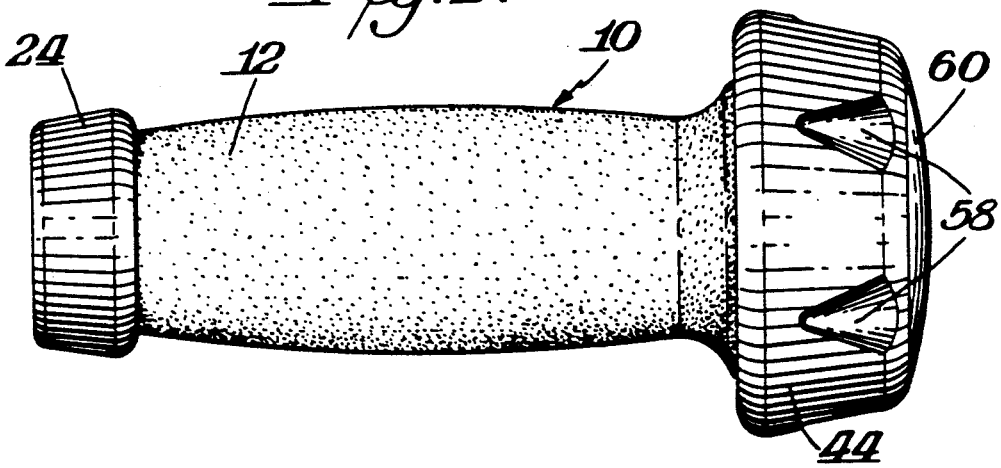
FIG. 2 is a side elevational view of the wrist exercise device shown in FIG. 1.
Figure 3:
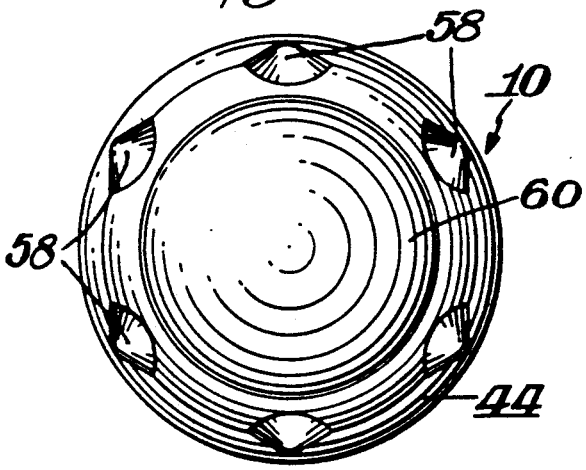
FIG. 3 is a right end elevational view of the wrist exercise device shown in FIGS. 1-2.
Figure 4:
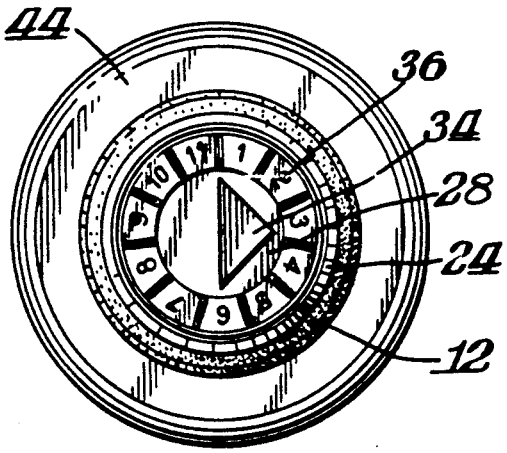
FIG. 4 is a left end elevational view of the wrist exercise device shown in FIGS. 1-3.

As shown in FIG. 4 the exposed face of adjustment ring cap 28 is provided with an indicator or arrow 34. Indicator arrow 34 is disposed along indicia 36 on the outer face of adjustment ring 24. By the fixed threaded engagement of adjustment ring cap 28 with bolt end 20 the setting indicated by indicator 34 in association with indicia 36 would change in accordance with the rotation of adjustment ring 24 relative to handle 12 and bolt 16.

As also shown in FIG. 5 a flat washer 38, such as a $\frac{3}{8}$ inch washer is mounted against handle 12 between the end of handle 12 and washer 22 and the shoulder 40 formed in adjustment cap 24. The peripheral extension 42 of adjustment cap 24 is dimensioned to fit around the tapered surface at the end of handle 12 and conceal washers 22 and 38. Flat washer 38 functions as a metal bearing surface for spring washer 22 to protect plastic handle 12.

As also illustrated in FIG. 5 a knob 44 is provided at the opposite end of handle 12 for relative rotation with respect to handle 12. Knob 44 includes an annular inward extension 46 with a clutch disc 48 and 50 mounted on each side of extension 46. Outer clutch disc 50 is disposed against pressure plate 52 which is sandwiched between enlarged head 18 of bolt 16 and the end wall of handle 12. At least one pin 54 extends through plate 52 and into handle 12 to prevent any relative rotation of pressure plate 52 with respect to handle 12. Thus, although bolt 16 extends through an opening 53 in plate 52 there is no relative rotation between plate 52 and bolt 16 or handle 12.

Figure 7:
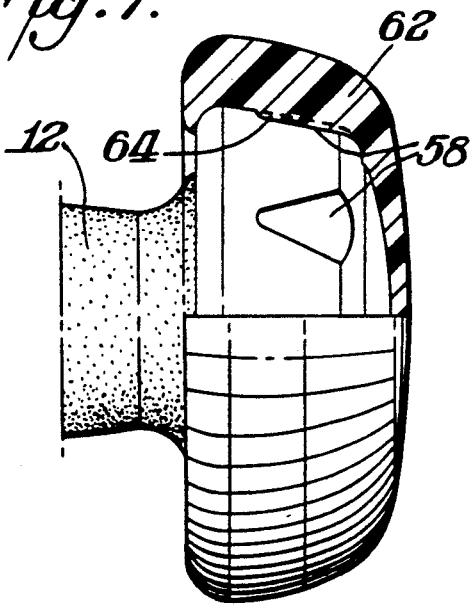
FIG. 7 is a side elevational view partly in section showing the mounting of a supplemental grip to the exercise device shown in FIGS. 1-6.

As illustrated a plurality of gripping elements 58 are provided on the outer surface of knob 44 to facilitate the user gripping and rotating knob 44. The gripping elements may be protrusions or depressions. As later described the gripping elements engage complementary structure on the inner surface of detachable grip member 62 (FIG. 7).

As illustrated knob 44 is of generally annular shape having an open outer end to facilitate the assembly of the various components. The open end is then closed by a knob cap 60 which not only conceals unsightly parts, such as bolt head 18 and pin 54, but also provides a surface on which, for example, advertising logo may be placed.

In practice adjustment cap 28 is screwed to the end of bolt 16 by engagement of threaded member 30 into threaded opening 32. Threaded member 30 may be a round head screw. When adjustment ring 24 is rotated clockwise it compresses bellville washer 22. Washer 22 reacts against handle 12 to increase the pressure on clutch discs 48 and 50 thereby increasing the force required to turn or rotate knob 44 with respect to handle 12. Since adjustment ring 24 has indicia 36 on its outer face disposed opposite indicator arrow 34 the user can readily determine the position of adjustment ring 24 and the compression of bellville washer 22. Extension 46 of knob 44, like plate 52, acts as an abutment member for its clutch disc.

As indicated bellville washer 22 acts as a compression spring which applies tension to the bolt 16 forcing the clutch discs 48,50 against the knob 44 and pressure plate 52 and handle 12. The handle 12 could be held stationary with one hand and the knob 44 is turned with the other hand. Alternatively handle 12 can be turned while knob 44 is held stationary producing the restraining forces required for exercising the wrists.

The clutch discs 48 and 50 provide the necessary friction and wear surfaces as the handle and knob are rotated with respect to each other. Pressure plate 52 functions to transfer the spring force on the head 18 of bolt 16 to the clutch discs 48,50. Thus, the bolt 16 provides a means of adjusting the tension on the bellville washer 22. Extension 46 of knob 44, like plate 52, acts as an abutment member for its clutch disc.

Flat washer 38 functions to prevent bellville washer 22 from damaging the plastic handle 12. Pin 54 functions to restrain the pressure plate 52 from turning with respect to handle 12 thereby providing four clutch bearing surfaces.

In initial operation the user would initially set up wrist exercise device 10 to its zero adjustment. This would be accomplished by turning adjustment ring 24 so that there is minimum force required to turn the knob 44 with respect to handle 12. While holding the adjustment ring 24 and handle 12 together, the cap screw 30 would be loosened and the cap 28 would be turned until the arrow 34 points to the zero reading on indicia 36. The screw 30 would then be tightened thereby conditioning device 10 for use.

In further operation when it is desired to increase the force for turning the knob 44 and handle 12 with respect to each other, adjustment ring 24 would be rotated so that the arrow 34 progressively points to a higher number on indicia 36.

A further feature of this invention is the provision of a larger grip member 62, such as illustrated in FIG. 7. Grip member 62 is designed to snap on and off knob 44, thus providing a larger and softer hand hold for more comfort. In this respect, grip member 62 would be made of a softer material than knob 44. To facilitate the gripping of grip member 62 its outer surface could be textured. Interchangeable grips provided by grip member 62 provides the flexibility of customizing the knob in accordance with the size of the hands of the individual user.

As illustrated grip member 62 includes a plurality of mounting members 64 which fit in depressions 58 of knob 44 so as to firmly hold grip member 62 on knob 44 without any relative rotation therebetween.

In the preferred practice of the invention handle 12, ring 24, knob 44 and cap 28 are all made of suitable plastic materials. Bolt 16, insert 23, spring 22, washer 38 and plate 52 as well as pin 54 are preferably made of metal materials. Although FIG. 5 illustrates only one pin 54 a plurality of pins may be used for mounting plate 52 to handle 12. If desired, head 18 may include enlarged extensions having openings through which the pins 54 may extend.

The invention may be practiced with certain variations. For example, instead of having a bellville washer mounted against an internally threaded insert which engages the externally threaded end 20 of bolt 16, it is possible to use other compression spring means. It is also possible to simply mount the bellville washer or other types of spring over the exposed end of member 16. In this variation member 16 need not be a bolt but could be a rod or shaft having a smooth unthreaded end 20. Thus member 16 may broadly be considered as a shaft which functions to provide a means of adjusting tension. When the shaft is provided with threads at one end and a head at the other end the shaft may be a bolt as illustrated. Otherwise any other suitable structure may be used in accordance with the remaining components with which the shaft interacts. Where shaft or member 16 is not a bolt, ring 24 would be mounted on shaft 116 for longitudinal movement on the shaft to control the amount of compression of the spring.

Other variations are also possible within the concepts of this invention.

What is claimed is:

1. A wrist exercise device comprising a handle having an axial opening extending completely therethrough, said handle having a first end and a second end, a shaft extending completely through said axial opening at said first end and said second end of said handle, spring means mounted outside of said handle around an end of said shaft at said first end of said handle, an adjustment ring mounted to said shaft spaced from said first end of said handle, said spring means being mounted in the space between said handle and said adjustment ring, said adjustment ring being longitudinally mounted on said shaft and having a bearing surface which is disposed against said spring means to adjust the extent of compression of said spring means upon longitudinal movement of said adjustment ring toward and away from said handle, at least one clutch disc mounted against said handle at said second end of said handle, an abutment member mounted against said clutch disc, and a knob mounted around said abutment member and said clutch disc and said second end of said handle in rotational relationship with respect to said handle whereby said knob and said handle may be rotated with respect to each other against the force applied by said clutch disc which is adjusted in accordance with the compression of said spring means.

2. The device of claim 1 wherein said adjustment ring is rotatably mounted to said shaft, said abutment member being a pressure plate, and said pressure plate being mounted to said second end of said handle in nonrotational relationship thereof.

3. The device of claim 2 wherein said adjustment ring includes a seat, an adjustment ring cap being mounted in said seat and secured to said shaft whereby said adjustment ring and said adjustment ring cap are mounted for relative rotation with respect to each other, indicia on said adjustment ring peripherally arranged with respect to said adjustment ring cap, and an indicator on said adjustment ring cap disposed toward said indicia to indicate the amount of compression of said spring means in accordance with the rotational movement of said adjustment ring with respect to said adjustment ring cap.

4. The device of claim 3 wherein said shaft is a bolt having a threaded end around which said spring means is mounted and having an enlarged head disposed against said plate.

5. The device of claim 4 wherein said knob includes an inward extension, one of said clutch discs being mounted on each side of said inward extension to comprise a first and a second clutch disc, said first clutch disc being disposed between said extension and said handle, said second clutch disc being disposed between said extension and said plate, and a pin extending through said plate and into said handle to prevent said plate from rotating with respect to said handle.

6. The device of claim 5 wherein said spring means is a bellville washer, and said adjustment ring having an annular extension around said first end of said handle concealing said bellville washer.

7. The device of claim 6 wherein said cap includes a screw mounted to said bolt.

8. The device of claim 7 including a detachable grip member mounted over said knob.

9. The device of claim 8 including a knob cap over said knob covering said head of said bolt.

10. The device of claim 9 wherein said handle and said grip member have textured outer surfaces.

11. The device of claim 10 wherein said knob includes spaced depressions, and said grip member includes mounting members on its inner surface for engagement with said spaced depressions.

12. The device of claim 7 including a flat washer between said bellville washer and said handle, and said bearing surface of said adjustment ring being on an insert secured to said adjustment ring and threadedly engaged with said bolt.

13. The device of claim 12 wherein said bolt and said bellville washer and said flat washer and said plate and said pin and said insert are made of metal, and said handle and said knob and said adjustment ring and said adjustment ring cap are made of plastic.

14. The device of claim 2 wherein said shaft is a bolt having a threaded end around which said spring means is mounted and having an enlarged head disposed against said plate.

15. The device of claim 14 wherein said knob includes an inward extension, one of said clutch discs being mounted on each side of said inward extension to comprise a first and a second clutch disc, said first clutch disc being disposed between said extension and said handle, said second clutch disc being disposed between said extension and said plate and a pin extending through said plate and into said handle to prevent said plate from rotating with respect to said handle.

16. The device of claim 15 wherein said spring means is a bellville washer, and said adjustment ring having an annular extension around said first end of said handle concealing said bellville washer.

17. The device of claim 8 including a detachable grip member mounted over said knob.

* * * * *